US007874379B2

(12) United States Patent
Saf

(10) Patent No.: US 7,874,379 B2
(45) Date of Patent: Jan. 25, 2011

(54) DAMPING DEVICE FOR AN OUTPUT SHAFT IN A GEARBOX

(75) Inventor: Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 727 days.

(21) Appl. No.: 11/883,404

(22) PCT Filed: Feb. 27, 2006

(86) PCT No.: PCT/IB2006/000390

§ 371 (c)(1),
(2), (4) Date: Jul. 30, 2007

(87) PCT Pub. No.: WO2006/095227

PCT Pub. Date: Sep. 14, 2006

(65) Prior Publication Data

US 2008/0149392 A1 Jun. 26, 2008

(30) Foreign Application Priority Data

Mar. 11, 2005 (SE) ..... 0500558

(51) Int. Cl.
*E21B 7/24* (2006.01)

(52) U.S. Cl. ..... 175/56; 173/176

(58) Field of Classification Search ..... 175/56, 175/170, 24; 173/176, 178
See application file for complete search history.

(56) References Cited

U.S. PATENT DOCUMENTS

| | | | | |
|---|---|---|---|---|
| 3,486,098 | A | 12/1969 | Bullinger et al. | |
| 4,890,680 | A | 1/1990 | Porsfeld et al. | |
| 5,690,184 | A | 11/1997 | Tsuchiya et al. | |
| 6,994,172 | B2 * | 2/2006 | Ray | 175/24 |
| 7,093,679 | B1 * | 8/2006 | Watson | 175/170 |
| 2007/0140801 | A1 * | 6/2007 | Kuttel et al. | 408/129 |
| 2009/0314884 | A1 * | 12/2009 | Elliott et al. | 244/99.9 |

FOREIGN PATENT DOCUMENTS

| | | | |
|---|---|---|---|
| DE | 3714255 | | 11/1988 |
| EP | 0523252 | | 1/1993 |
| EP | 1178588 | | 2/2002 |
| GB | 1304449 | | 1/1973 |
| SU | 850326 B | * | 7/1981 |

* cited by examiner

*Primary Examiner*—Daniel P Stephenson
(74) *Attorney, Agent, or Firm*—Mark P. Stone

(57) ABSTRACT

The invention relates to a damping device for an output shaft (26) in a gearbox (14, 16), where the gearbox (14, 16) is arranged for rotation of a rotational degree of freedom (Z4, Z5) in a rock-drilling rig (2), and thus for positioning of the same, and where the damping device (18) comprises a brake (38) that acts on the output shaft (26) of the gearbox (14, 16), which brake (38) acts as an oscillation damper for the movement of the output shaft (26), whereby a gearbox (14, 16) with play can be used for applications that require a high degree of precision such as positioning, e.g. measuring a position for a drill hole. The invention also relates to a gearbox (14, 16) and a rock-drilling rig (2) with damping device (18), respectively.

20 Claims, 3 Drawing Sheets

DAMPING DEVICE FOR AN OUTPUT SHAFT IN A GEARBOX

TECHNICAL FIELD

The present invention relates to a damping device in a rock-drilling rig. The invention also relates to a gearbox and a rock-drilling rig with damping device.

BACKGROUND

On modern rock-drilling rigs, the positions of the drill booms are measured in order to be able to drill the holes in the correct place in the rock, possibly by using automatic controls. When measuring a position for a drill hole, the angles are measured at each joint of the drill booms and any telescopic movement of these. A boom has normally five to six joints, for which reason the measuring must be carried out with a high degree of precision in order to be able to calculate where the hole will be drilled.

Gearboxes can be used in order to achieve rotations in the joints of the drill booms, whereby it is possible to choose between using expensive special gearboxes without play or cheaper standard gearboxes with play.

U.S. Pat. No. 5,690,184 A shows a rock drilling apparatus, EP 0 523 252 A1 shows suppression of vibrations in a robot arm, EP 1 178 588 A2 shows a stepping motor, and GB 1 304 449 A shows an apparatus for providing coating for a flexible web of material.

A problem when using a gearbox with play, for positioning in a joint in a drill boom is that the force from the inertia in the drill boom can cause the load from the drill boom acting upon the output shaft of the gearbox to shift between the gear-tooth flanks in the gearbox. This "chatter" or oscillation between the gear-tooth flanks arises in particular with low loads on the gearbox, that is when positioning the drill boom before drilling is commenced. Thus, in applications that require great precision, it has been necessary to use gearboxes that do not have any play, which has resulted in the use of expensive gearboxes, as standard gearboxes for transmissions have play of the order of 0.3 degrees which can not be accepted for, for example, positioning.

BRIEF DESCRIPTION OF THE INVENTION

The problem that, in gearboxes with play, the load acting upon the output shaft can shift between, the gear-tooth flanks during positioning is solved according to the invention by arranging a damping device for an output shaft in a gearbox that is used for positioning, where the damping device comprises a brake that acts upon the output shaft of the gearbox, which brake acts as an oscillation damper for the movement of the output shaft.

By that the damping device has the characteristics in claim 1, the advantage of bringing about a gearbox with play that can be used for applications that require a high degree of precision, such as positioning, is attained whereby inexpensive gearboxes with play can be utilized for measuring a position for a drill hole. The damping device is, as can be seen in claims 9 and 10, preferably arranged in a gearbox in a rock-drilling rig.

Preferred embodiments of the invention are described in the dependent claims.

BRIEF DESCRIPTION OF DRAWINGS

The invention will be described below in greater detail with reference to the attached drawings, in which.

DESCRIPTION OF PREFERRED EMBODIMENTS

Figure 1:
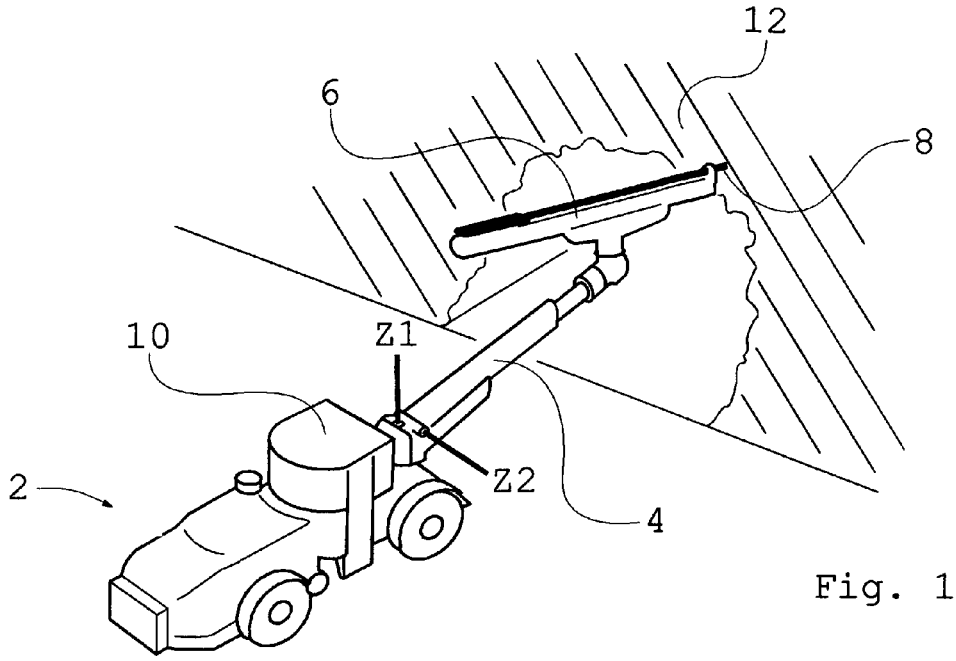
FIG. 1 shows schematically a view of a rock-drilling rig.

FIG. 1 shows schematically a view of a rock-drilling rig 2, comprising a drill boom 4, a feeder 6 and a cutter head 8. The rock-drilling rig 2 can be remotely controlled by an operator via a cable (not shown) or by wireless means, but can also be controlled by an operator located in a cab 10 on the rock-drilling rig 2. The operator can control the rock-drilling rig 2 either manually, automatically or semi-automatically. When the operator wants to drill a hole in rock 12 using the rock-drilling rig 2, it is important to be able to position the cutter head 8, that is the feeder 6, in the correct position and at a correct angular direction in relation to the rock 12, in order to create a required hole, in particular when several holes are to be drilled into the rock 12 parallel to each other, as takes place, for example, when drilling a tunnel through a mountain.

Figure 2:
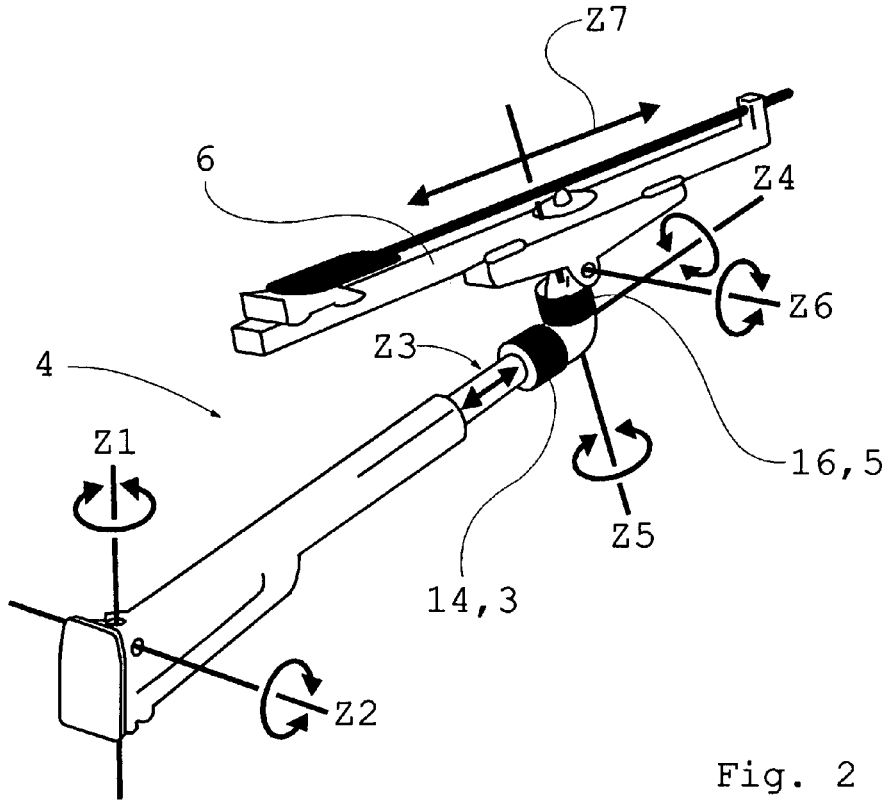
FIG. 2 shows schematically a view of a drill boom on a rock-drilling rig according to FIG. 1.

FIG. 2 shows schematically a view of a drill boom 4 on a rock-drilling rig 2 according to FIG. 1. According to this embodiment, the drill boom 4 has five rotational degrees of freedom Z1, Z2, Z4, Z5, Z6, a telescopic degree of freedom Z3 at the telescopic part of the drill boom 4 and an additional telescopic degree of freedom Z7 in the form of feed movement and feed for the moveable feeder 6. When measuring a position for a drill hole, on the one hand the angles are measured at each joint of the drill boom 4 that has a rotational degree of freedom Z1, Z2, Z4, Z5, Z6, that is at each joint where rotation is possible and, on the other hand, any telescopic movements of the drill boom 4 are measured, that is any telescopic movements at the places on the drill boom 4 that have telescopic degrees of freedom Z3, Z7. In this embodiment, gearboxes 14, 16 are used to achieve the rotations in two of the joints 3, 5 of the drill boom 4, that is to adjust the angle of two rotational degrees of freedom Z4, Z5 of the drill boom 4.

Figure 3:
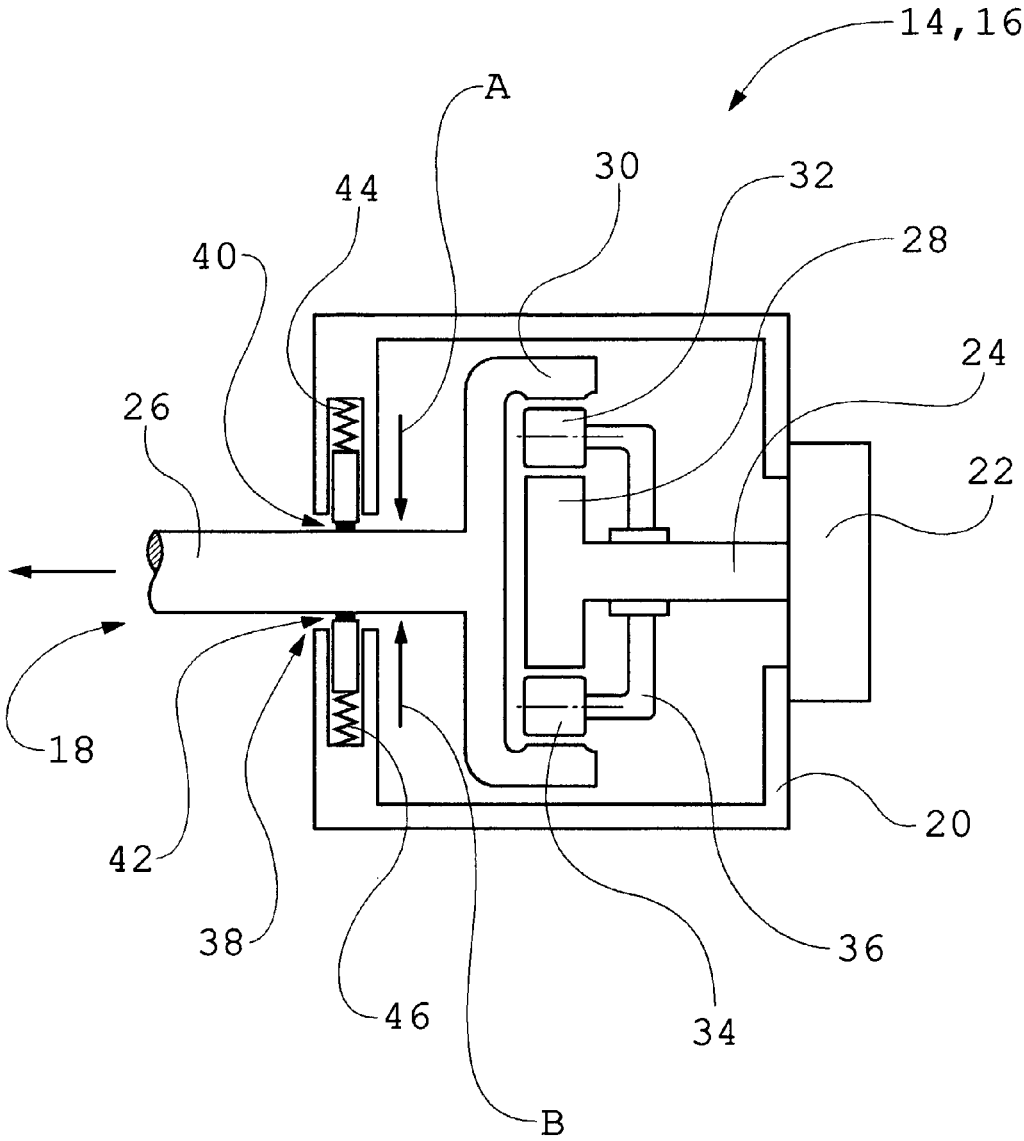
FIG. 3 shows schematically a first embodiment of a damping device according to the invention.

FIG. 3 shows schematically a first embodiment of a damping device 18 according to the invention. The figure shows a gearbox 14, 16 with a gearbox housing 20, a propulsion motor 22 arranged to drive the gearbox 14, 16, an input shaft 24 for the gearbox 14, 16, and an output shaft 26 for the gearbox 14, 16. In this embodiment, the gearbox 14, 16 is a planetary gear, for which the inner sun wheel 28, outer sun wheel 30, planet pinions 32, 34 and planet pinion carrier 36 are also shown in the figure. The propulsion motor 22 can be a piston engine, e.g. a hydraulic engine. By the use of a compact piston engine, sideways protrusion of the propulsion motor 22 is avoided, which is an advantage when the propulsion motor 22 is to be mounted on a drill boom 4. The damping device 18 comprises a brake that acts on the output shaft 26 of the gearbox 14, 16, which brake 38 acts as an oscillation damper for the movement of the output shaft 26. The brake 38 acts preferably on the output shaft 26 of the gearbox 14, 16 without a tendency to move the shaft 26 sideways, and thus comprises preferably at least two friction elements 40, 42 that act, when braking the output shaft 26 of the gearbox 14, 16, on the surface of the shaft 26 with braking forces A, B that are essentially equal in size and act in pairs in opposite directions. The brake is active at least during positioning, but is preferably activated constantly. When the brake 38 is activated constantly, the braking force on the output shaft 26 is suitably of the order of some percent up to approximately 30%, preferably approx 10%, of the torque that is provided by the propulsion motor 22 for the gearbox 14, 16 when the propulsion motor 22 is operating at normal output power, so that the output shaft 26 of the gearbox 14, 16 can be rotated by the propulsion motor 22 without problems when so required. This constant activation of the brake 38 can, for example, be achieved by that the friction elements 40, 42 that act on the surface of the output shaft 26 of the gearbox 14, 16 are pressed towards the shaft 26 by preloaded springs 44, 46.

Figure 4:
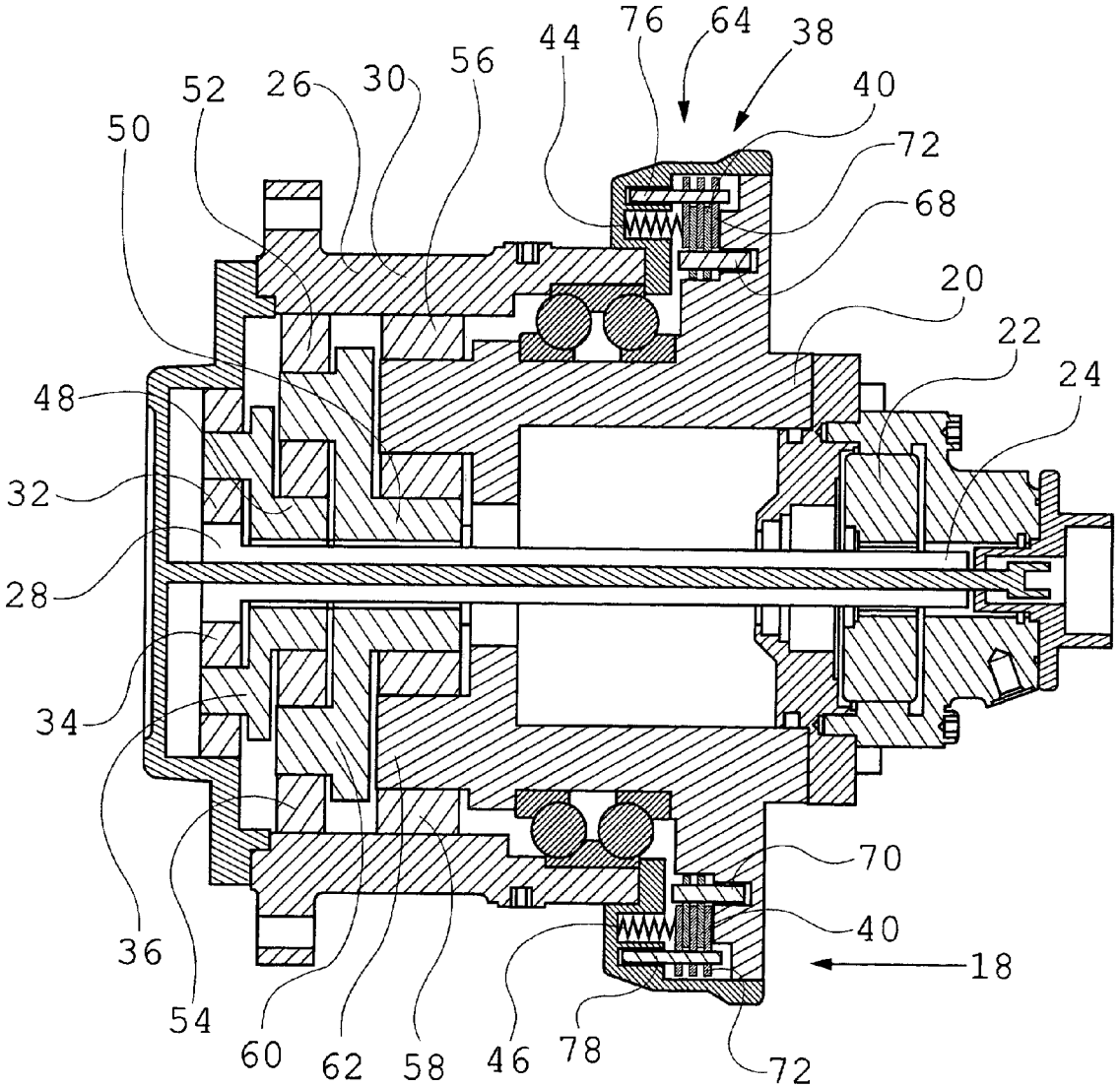
FIG. 4 shows schematically a second embodiment of a damping device according to the invention.

FIG. 4 shows schematically a second embodiment of a damping device 18 according to the invention. The figure shows a gearbox 14, 16 with a gearbox housing 20, a propulsion motor 22 arranged to drive the gearbox 14, 16, an input shaft 24 for the gearbox 14, 16, and an output shaft 26 for the gearbox 14, 16. In this embodiment, the gearbox 14, 16 is a three-stage planetary gear for which the inner sun wheel 28; 48; 50, outer sun wheel 30, planet pinions 32, 34; 52, 54; 56, 58 and planet pinion carriers 36; 60; 62 are also shown in the figure for the different stages in the planetary gear. The propulsion motor 22 can be a piston engine. By using a compact piston engine, sideways protrusion of the propulsion motor 22 is avoided, which is an advantage when the propulsion motor 22 is to be mounted on a drill boom 4. The damping device 18 comprises a brake 38 that acts on the output shaft 26 of the gearbox 14, 16, which brake 38 acts as an oscillation damper for the movement of the output shaft 26. The brake 38 acts preferably on the output shaft 26 of the gearbox 14, 16 without a tendency to move the shaft 26 sideways, and thus comprises preferably at least one multiplate friction unit 64 arranged concentrically around the output shaft 26 of the gearbox 14, 16. Each multiplate friction unit 64 comprises friction elements 40 in the form of brake plates that are attached to the gearbox housing 20 by means of pins 68; 70 and friction elements 72 in the form of brake plates that are attached to the output shaft 26 of the gearbox 14, 16 by means of pins 76; 78, respectively. The brake 38 is active at least during positioning, but is preferably activated constantly. When the brake 38 is activated constantly, the braking force on the output shaft 26 is suitably of the order of some percent up to approximately 30%, preferably approximately 10%, of the torque that is provided by the propulsion motor 22 for the gearbox 14, 16 when the propulsion motor 22 is operating at normal output power, so that the output shaft 26 of the gearbox 14, 16 can be rotated by the propulsion motor 22 without problems when so required. This constant activation of the brake 38 can, for example, be achieved by that the multiplate friction unit 64 comprising the friction elements 40 attached to the gearbox housing and the friction elements 72 attached to the output shaft 26 of the gear box 14, 16 is pressed together by preloaded springs 44, 46.

By utilizing a damping device of the type mentioned above for gearboxes 14, 16 with play that are used to achieve rotations in two of the joints of the drill boom 4, the play in the gearbox 14, 16 does not affect the precision of the output shaft 24 of the gearbox 14, 16 as the damping device acts on the output shaft 24 of the gearbox 14, 16, which provides a high degree of play-free precision in these joints for positioning of the drill boom 4.

The invention thus relates to a damping device for an output shaft 26 in a gearbox 14, 16, where the gearbox 14, 16 is arranged for rotation of a rotational degree of freedom Z4, Z5 in a rock-drilling rig 2, and thus for positioning of the same, and where the damping device 18 comprises a brake 38 that acts on the output shaft 26 of the gearbox 14, 16. In a preferred embodiment the brake acts between the output shaft 26 of the gearbox 14, 16, or a part attached to this, and the gearbox housing 20, or a part firmly attached to this, of the rock-drilling rig 2, respectively. Said brake 38 acts as an oscillation damper for the movement of the output shaft 26, whereby a gearbox 14, 16 with play can be used for applications that require a high degree of precision such as positioning, e.g. measuring a position for a drill hole.

As mentioned above the invention also relates to a gearbox 14, 16 and a rock-drilling rig 2 with damping device 18, respectively.

The damping device 18 thus acts as an oscillation damper for the movement of a rotational degree of freedom Z4, Z5 in a joint 3, 5 in the rock-drilling rig 2.

The damping device according to the invention is illustrated as being arranged in a gearbox in a drill boom on a rock-drilling rig, but can also be used in other types of mining or construction machines where a similarly accurate movement is required.

The damping device may instead of as illustrated, integrated in a gear box, also be mounted outside of the gear box itself and act between parts in a rock-drilling rig attached to the gear box housing and the output shaft of the gearbox, respectively.

The invention claimed is:

1. A damping device in a rock-drilling rig (2), characterized in that a gearbox (14, 16) is arranged for rotation of a rotational degree of freedom (Z4, Z5) in the rock-drilling rig (2), and thus for positioning of the same, and that the damping device (18) comprises a brake (38) that acts on an output shaft (26) of the gearbox (14, 16), which brake (38) acts as an oscillation damper for the movement of the output shaft (26).

2. The damping device as claimed in claim 1, characterized in that the damping device (18) comprises a brake (38) which acts between the output shaft (26) of the gearbox (14, 16), or a part attached to this, and the gearbox housing (20), or a part firmly attached to this, of the rock-drilling rig (2), respectively.

3. The damping device as claimed in claim 2, characterized in that the brake (38) comprises at least two friction elements (40, 42) that, when braking the output shaft (26) of the gearbox (14, 16), act on the surface on the shaft (26).

4. The damping device as claimed in claim 2, characterized in that the brake (38) comprises at least one multiplate friction unit (64), where each multiplate friction unit (64) comprises friction elements (40) that are attached to the gearbox housing (20) and friction elements (72) that are attached to the output shaft (26) of the gearbox (14, 16), respectively.

5. The damping device as claimed in claim 2, characterized in that the braking force of the brake (38) is 3% to 30%, preferably 10%, of the torque that is provided by a gearbox (14, 16) propulsion motor (22) when the propulsion motor (22) is operating at normal output power.

6. The damping device as claimed in claim 2, characterized in that the brake (38) is constantly activated.

7. The damping device as claimed in claim 1 characterized in that the brake (38) comprises at least two friction elements (40, 42) that, when braking the output shaft (26) of the gearbox (14, 16), act on the surface on the shaft (26).

8. The damping device as claimed in claim 7, characterized in that the friction elements (40, 42), when braking the output shaft (26) of the gearbox (14, 16), act on the surface of the shaft (26) with braking forces (A, B) that are essentially equal in size and act in pairs in opposite directions.

9. The damping device as claimed in claim 8, characterized in that the braking force of the brake (38) is 3% to 30%, preferably 10%, of the torque that is provided by a gearbox (14, 16) propulsion motor (22) when the propulsion motor (22) is operating at normal output power.

10. The damping device as claimed in claim 8, characterized in that the brake (38) is constantly activated.

11. The damping device as claimed in claim 7, characterized in that the braking force of the brake (38) is 3% to 30%, preferably 10%, of the torque that is provided by a gearbox (14, 16) propulsion motor (22) when the propulsion motor (22) is operating at normal output power.

12. The damping device as claimed in claim 7, characterized in that the brake (38) is constantly activated.

13. The damping device as claimed in claim 1 characterized in that the brake (38) comprises at least one multiplate friction unit (64), where each multiplate friction unit (64) comprises friction elements (40) that are attached to the gearbox housing (20) and friction elements (72) that are attached to the output shaft (26) of the gearbox (14, 16), respectively.

14. The damping device as claimed in claim 13, characterized in that the braking force of the brake (38) is 3% to 30%, preferably 10%, of the torque that is provided by a gearbox (14, 16) propulsion motor (22) when the propulsion motor (22) is operating at normal output power.

15. The damping device as claimed in claim 13, characterized in that the brake (38) is constantly activated.

16. The damping device as claimed in claim 1, characterized in that the braking force of the brake (38) is 3% to 30%, preferably 10%, of the torque that is provided by a gearbox (14, 16) propulsion motor (22) when the propulsion motor (22) is operating at normal output power.

17. The damping device as claimed in claim 1, characterized in that the brake (38) is constantly activated.

18. The damping device as claimed in claim 17, characterized in that the constant activation of the brake (38) is achieved by the brake (38) being acted upon by preloaded springs (44, 46).

19. Gearbox comprising a damping device (18) as claimed in claim 1.

20. Rock drilling rig comprising a damping device (18) as claimed in claim 1.

* * * * *